United States Patent [19]

Meschke

[11] Patent Number: 4,603,755

[45] Date of Patent: Aug. 5, 1986

[54] RAPPEL LINE CLAMP AND HARNESS

[75] Inventor: Juergen Meschke, Atlanta, Ga.

[73] Assignee: Mar-Mex International, Ltd., Atlanta, Ga.

[21] Appl. No.: 698,038

[22] Filed: Feb. 4, 1985

[51] Int. Cl.[4] ..... A62B 1/14

[52] U.S. Cl. ..... 182/5; 182/193; 188/65.2

[58] Field of Search ..... 182/4–7, 182/236, 235, 240, 71, 72, 190–193; 188/65.1–65.5, 65.7; 16/265, 356, 580

[56] References Cited

U.S. PATENT DOCUMENTS

| | | | |
|---|---|---|---|
| 2,866,997 | 1/1959 | Eskridge | 16/265 |
| 2,872,144 | 2/1959 | Hobson | 248/224.2 |
| 3,717,219 | 2/1973 | Hoffman | 182/6 |
| 4,052,067 | 10/1977 | Casavant | 273/74 |
| 4,056,166 | 11/1947 | Rabelos | 182/5 |
| 4,448,281 | 5/1984 | Adams | 182/5 |

FOREIGN PATENT DOCUMENTS

| | | | |
|---|---|---|---|
| 14350 | of 1888 | United Kingdom | 188/65.4 |

*Primary Examiner*—Reinaldo P. Machado
*Assistant Examiner*—Alvin Chin-Shue
*Attorney, Agent, or Firm*—Jones & Askew

[57] ABSTRACT

The present invention relates to a rappel line clamp and harness with which the descent down a rope may be readily controlled.

The rappel line clamp and harness of the present invention includes a first and a second elongated juxtaposed plate. The pair of plates includes opposing and remote sides. The plates define corresponding first and second longitudinal marginal portions and a corresponding first and second transverse end marginal portions. The first pair of corresponding longitudinal marginal portions include a means for pivotally interconnecting the plates for limited swinging apart of a second pair of corresponding longitudinal edge portions. The opposing sides of the plates include full length opposing and registered longitudinal open ended grooves formed therein approximately intermediate between the plate longitudinal marginal portions. The second pair of corresponding longitudinal marginal portions of the plates include coacting adjustable clamp means so that said second pair of corresponding longitudinal marginal portions may be adjustably clamped together to thereby clamp a flexible member between the portions of the opposing sides of the plates defining the grooves.

4 Claims, 5 Drawing Figures

98
12
10
34
16
14
18

98
52
54
100
60
12
76
36
68
88
10
66
94
38
74
22
26
24

20
16
28
30
14
18
28
32

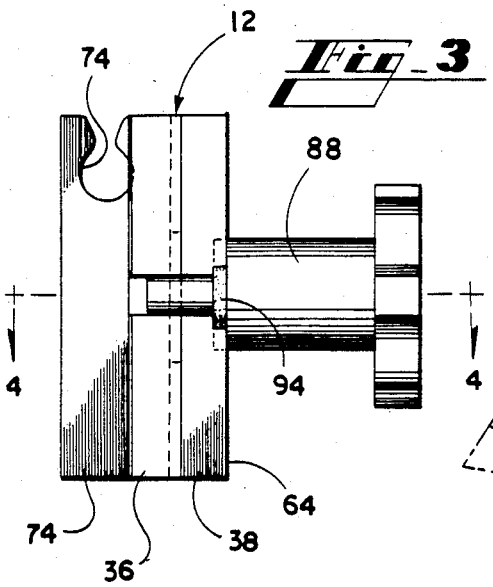
Fig. 3
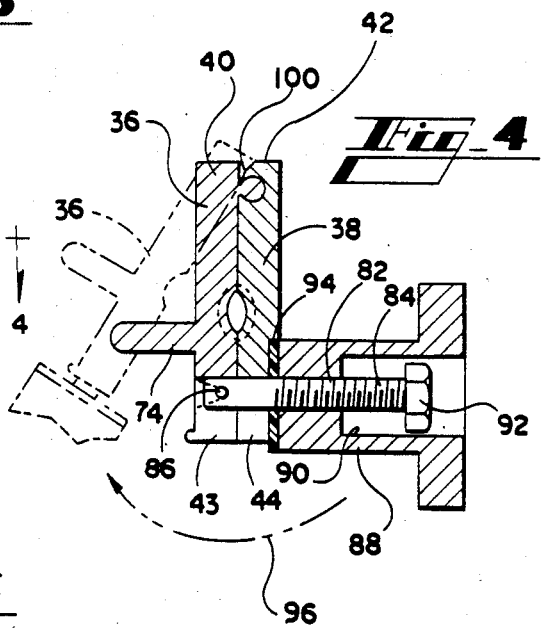
Fig. 4
Fig. 5
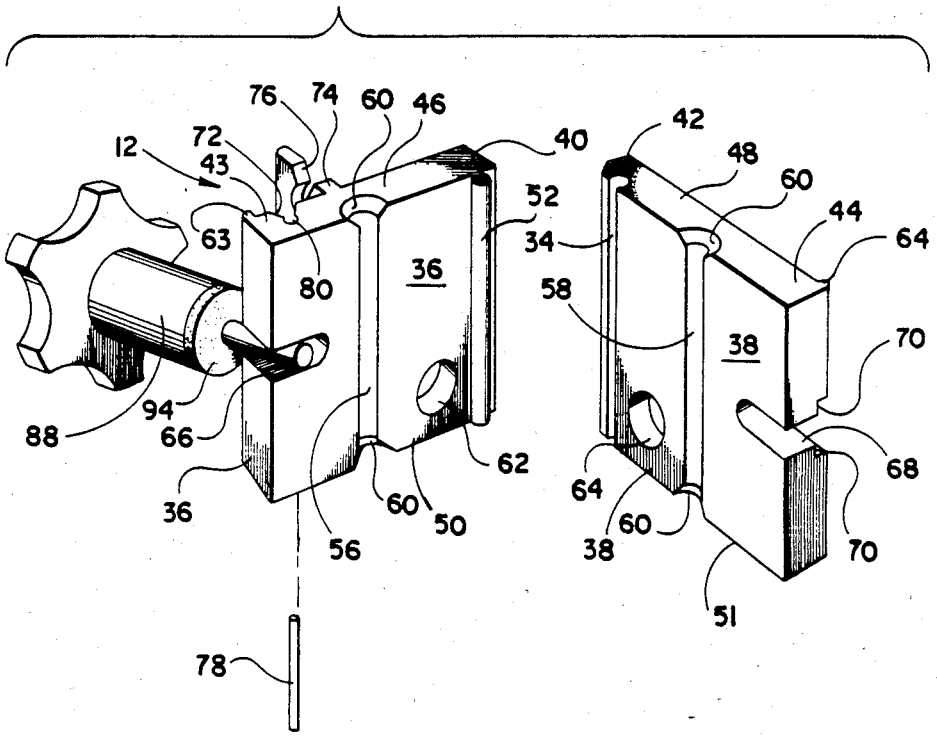

RAPPEL LINE CLAMP AND HARNESS

TECHNICAL FIELD

The present invention relates to a user-operated flexible single strand descent apparatus including a body harness supported from a descent retarder which can be adjusted by the user to control his or her descent. The apparatus may be used as a fire escape from the upper floors of a building, in mountain climbing and in various different types of rescue operations.

BACKGROUND OF THE INVENTION

Various forms of devices to control decent have been disclosed in the prior art. These devices include general structural and operational features of the present invention which heretofore have been provided.

One example of these previously known devices is disclosed in U.S. Pat. No. 287,491. This patent discloses a fire escape in which a rope is passed between clamping arms. The clamping arm is comprised of two pieces of wood. The two pieces of wood each have a flat inner surface and are fastened together at one end by means of a hinge. The outer sides of the free ends of the wood pieces are rounded so that they form a handle and may be gripped by the hand. The inner surfaces of the arms have two transverse grooves near the hinge in which a rope slides. A strap or belt is attached to the clamping arm. To use the fire escape, the belt is buckled on the person and a rope is attached to a firm structure. The rope is passed through the transverse groove in the clamping arm. The person may control his descent by clamping the two pieces of wood with his hand.

A problem with the above-described fire escape device is that it is difficult to control the rate of descent. Great pressure must be applied to the clamping arm in order to slow one's descent. In addition, the method of buckling the clamp to the body is awkward. Finally, there is no safety brake if the clamping arm should fail or if one does not have the strength to clamp the two pieces of wood.

U.S. Pat. No. 527,529 discloses a fire escape in which a rope passes through a clamp. The clamp has two parts that are hinged together. Both parts of the clamp are provided with half grooves. A rope is placed in the grooves and the two parts are closed together. A finger wheel is provided so that the two parts can be clamped together onto the rope. A second rope, in the form of a loop, is attached to the clamp which will hold the person during his descent. To use the device, the person tightens the finger wheel to slow his descent or loosens the finger wheel to speed his descent.

With this particular fire escape, it is difficult to control the rate of descent. One has to screw the finger wheel tighter to slow his descent while trying to hold on to the device while descending. In addition, there is no secondary mechanism to easily slow or stop the descent if one is unable to use the finger wheel.

U.S. Pat. No. 4,056,166 discloses a rope climbing device in which a person may control his descent. The device includes two plates that are attached to each other by a hinge. Each plate has a partial groove in the facing surfaces for engaging the rope. A screw-threaded bolt and nut assembly connects the two members. The members can be moved to or away from each other for varying the frictional engagement between the slide and the flexible member. A sling is attached to the device to hold a person. In addition, a hook is attached to the outer face of one of the members. The rope can be looped over the hook to help control the rate of descent.

This device is also difficult to control. Although it is supplied with a hook over which the user may loop the rope to better control his descent, since the hook is open, the rope can easily fall off the hook causing an uncontrolled descent.

SUMMARY OF THE INVENTION

The rappel line clamp and harness of the present invention solves the above problems in the prior art by incorporating a descent retarder for use in conjunction with a single descent line. The retarder includes a structure whereby the descent of the user may be readily controlled. In addition, the retarder includes structural features which substantially eliminate the possibility of malfunction of the descent retarder, even when the user of the device is inexperienced.

The rappel line clamp and harness of the present invention includes a first and a second elongated juxtaposed plate. The pair of plates includes opposing and remote sides. The plates define corresponding first and second longitudinal marginal portions and a corresponding first and second transverse end marginal portions. The first pair of corresponding longitudinal marginal portions include a means for pivotally interconnecting the plates for limited swinging apart of a second pair of corresponding longitudinal edge portions. The opposing sides of the plates include full length opposing and registered longitudinal open ended grooves formed therein approximately intermediate between the plate longitudinal marginal portions. The second pair of corresponding longitudinal marginal portions of the plates include coacting adjustable clamp means so that said second pair of corresponding longitudinal marginal portions may be adjustably clamped together to thereby clamp a flexible member between the portions of the opposing sides of the plates defining the grooves.

The user can open the rappel clamp and position a rope or line in the longitudinal grooves. The rappel clamp is then closed and the clamping means is tightened to provide pressure on the rope or line. When one sits in the harness that is attached to the clamp and loosens the clamping means, the rope slides through the grooves in the rappel clamp and the person slides down the rope. By tightening the clamping means, the friction on the rope sliding through the clamping means is increased and the person will slide down the rope at a slower speed. When the clamping means is loosened, the friction on the rope is decreased and the person will slide down the rope at a faster speed.

As a safety measure, the rappel clamp and harness of the present invention includes an outstanding flange extending longitudinally from one of the remote sides of the plates. The end of the flange has an outwardly opening keyhole shaped notch formed therein and extending transversely therethrough. The user of the rappel line clamp and harness of the present invention can loop the rope through the notch and can thereby further control the rate at which he descends. Because the notch is keyhole shaped, the rope will not accidentally slip out of the notch thereby causing potentially uncontrolled descent.

Thus, an object of the rappel line clamp and harness of the present invention is to provide an apparatus that can be used to safely slide down a rope or line at a controlled speed.

Another object of this invention is to provide a single strand descent apparatus including a load supporting descent retarder guidingly engaged with the associated single strand and including structure whereby the descent retarder may be operated to effect a controlled descent independent of the weight of the load supported by the descent retarder.

Another object of this invention is to provide a descent retarder and load supporting harness constructed in a manner whereby proper operation thereof may be readily accomplished by persons having minimum instruction on the operation thereof.

Still another object of this invention is to provide a descent retarder which may be used in conjunction with different types of descent lines or ropes.

Another important object of this invention is to provide a descent retarder including structural features thereof which may be initially constructed by extrusion processes.

A final object of this invention to be specifically enumerated herein is to provide a rappel line clamp and harness assembly in accordance with the preceding objects and which will conform to conventional forms of manufacture, be of simple construction and easy to use so as to provide a device that will be economically feasible, long lasting and relatively trouble free in operation.

While this invention has been described in detail with particular reference to preferred embodiments thereof, it will be understood that variations and modification can be effected within the spirit and scope of the invention as described hereinbefore and as defined in the appended claims.

BRIEF DESCRIPTION OF THE DRAWINGS

FIG. 3 is a right side elevational view of the line clamp.

FIG. 4 is a horizontal sectional view taken substantially upon the plane indicated by the section line 4—4 of FIG. 3 and with an alternate open position of the clamp illustrated in phantom lines.

FIG. 5 is an enlarged perspective view of the clamp with one of the plates nad the clamp screw retaining pin illustrated in exploded position.

DETAILED DESCRIPTION OF THE PREFERRED EMBODIMENT

Figures 1, 2:
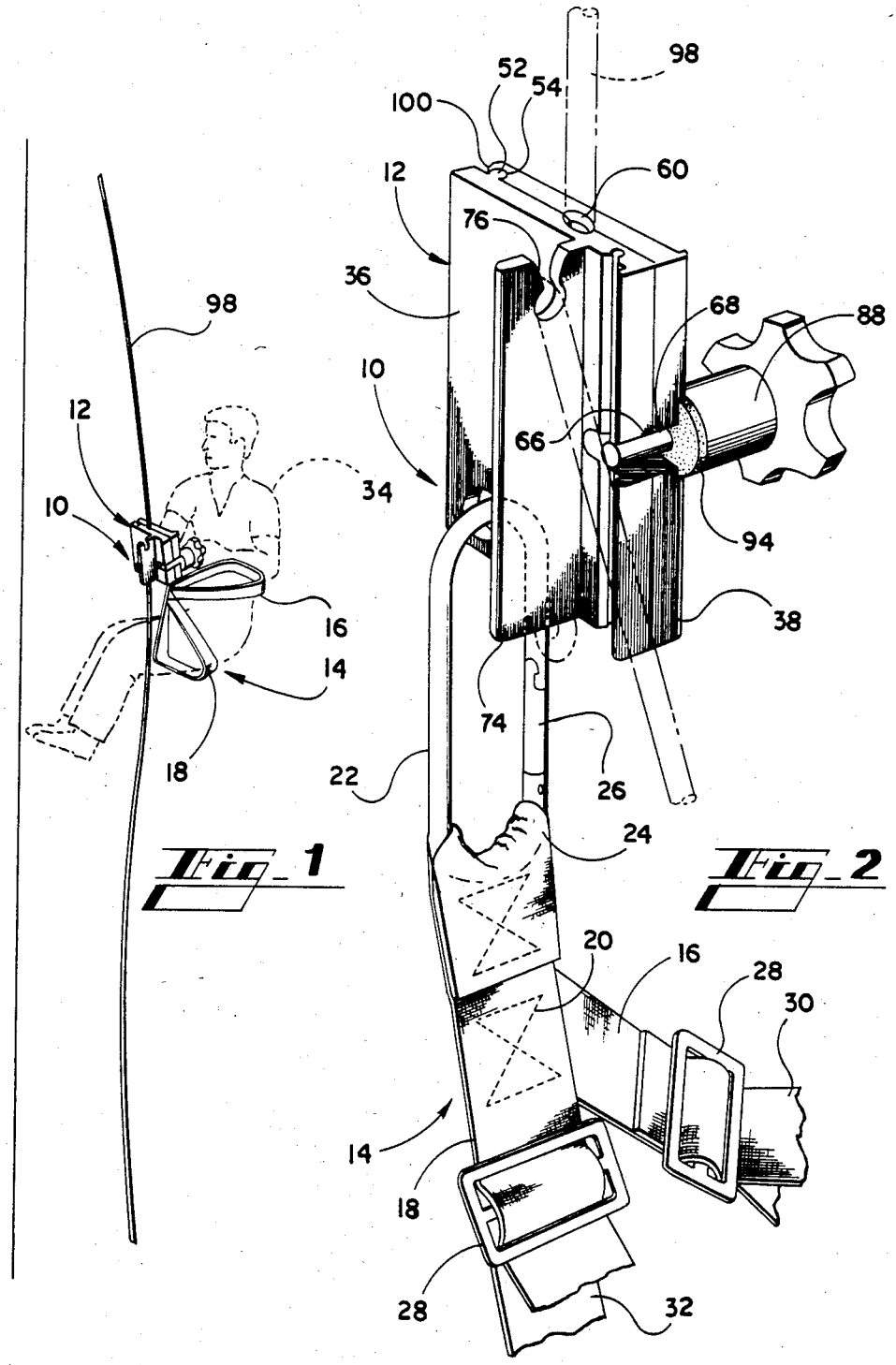
FIG. 1 is a perspective view of the present invention in operative association with a substantially vertically disposed rappel line and with an associated user illustrated in phantom lines.
FIG. 2 is an enlarged fragmentary perspective view of the clamp and harness portions of the invention and with an associated flexible line illustrated in phantom lines.

Referring now in more detail to the drawings, in which like reference numerals refer to like parts throughout the several views, FIG. 1 shows the combined rappel line clamp and harness assembly 10 of the present invention including a clamp construction 12 and a harness construction 14.

The harness construction 14 incorporates a pair of high strength strap members 16 and 18 sewn together at one pair of corresponding ends as at 20 and anchored relative to one end of an oval anchor ring 22 as at 24. The anchor ring 22 comprises a split ring and is equipped with a hinged and spring biased section 26 thereof which may be considered of conventional design. The section 26 is yieldingly biased to the closed position thereof illustrated in FIG. 2, but may be swung inwardly of the perimeter of the ring 22 at one end in order to form an opening in the ring 22. The strap members 16 and 18 each include buckles 28 whereby the other pair of ends of the strap members 16 and 18 may be adjustably anchored relative to the first mentioned ends thereof in order to form adjustable size loops 30 and 32 for encircling the waist and thigh areas of the user 34 of the assembly 10 as shown in FIG. 1.

The clamp construction 12 includes first and second plates 36 and 38 disposed in closely juxtaposed position in FIG. 4 and including first longitudinal marginal edge portions 40 and 42, second longitudinal marginal edge portions 43 and 44, first transverse end marginal edge portions 46 and 48 and second transverse marginal edge portions 50 and 51 as shown in FIGS. 4 and 5. The marginal edge 40 includes an outstanding longitudinal rib 52 of substantially cylindrical cross-sectional shape and the marginal edge portion 42 includes a longitudinal groove 54 formed therein which is partially cylindrical in cross section and slightly larger in transverse dimension than the rib 52. The rib 52 is longitudinally slidably received within and removable from the groove 54 and also rotatably received therein for limited relative oscillation of the plates 36 and 38 between the closed positions thereof illustrated in FIG. 4 and the open position of the plate 36 illustrated in phantom lines in FIG. 4.

The opposing facing of the plates 36 and 38 include registered semi-ellipse grooves 56 and 58 formed therein and the opposite ends of the grooves 56 and 58 are flared as at 60. Also, the plates 36 and 38 include registered circular openings 62 and 64 formed therein and the anchor ring 22 may be passed through the registered openings 62 and 64 in order to anchor the harness construction 14 to the clamp construction 12.

The longitudinal marginal edge portions 43 and 44 include longitudinal curbs 63 and 64 which extend therealong and project outwardly from the remote side faces of the plates 36 and 38. Marginal edge portions 43 and 44, however, include transverse outwardly opening slots 66 and 68 formed therein centrally intermediate the opposite ends thereof and while the slots 66 and 68 open outwardly through the corresponding curbs 63 and 64, the curb 64 is cut or notched away as at 70 for a short distance on opposite sides of the slots 68. Also, the plate 36 includes a longitudinal groove 72 formed in the side thereof remote from the plate 38 spaced slightly inward from the curb 63 and the groove 72 is interrupted by the slot 66. Also, the side of the plate 36 remote from the plate 38 includes an outstanding longitudinal flange 74 and the end of the flange 74 corresponding to the end marginal portion 46 has a keyhole-shaped notch 76 formed therein.

In addition to the plates 36 and 38, the clamp construction 12 includes an elongated pivot pin 78 wedgingly receivable within the partial cylindrical inner extremity 80 of the groove 72, a clamp screw externally threaded on one end as at 84 and pivotally anchored within the slot 66 at its other end by means of the pivot pin 78. The longitudinal mid-portion of the pivot pin 78 is rotatably received through a diametric bore 86 formed through the corresponding end of the clamp screw 82 and the opposite ends of the pivot pin 78 are frictionally retained within the adjacent ends of the opposite end sections of the groove 72 disposed on opposite sides of the slot 66.

The threaded end of the clamp screw 82 has a hand nut 88 threaded thereon and the outer end of the hand nut 88 includes a central recess 90 in which the free end of the clamp screw 82 is received. In addition, a lock nut 92 is threaded on the free terminal end of the clamp screw 82 within the recess 90 and prevents complete unthreading of the hand nut 88 from the clamp screw 82. Finally, an anti-friction washer 94 is disposed on the clamp screw 82 immediately inward of the nut 88.

When the nut 88 is loosened, the nut and the washer 94 are sufficiently spaced from the plate 38 to enable the clamp screw 82 to swing in a clockwise direction as indicated by the arrow 96 from the position thereof illustrated in FIG. 4 to a substantially opposite position. In this manner, the plate 36 may be swung from the closed position thereof illustrated in solid lines in FIG. 4 to the open phantom line position of FIG. 4 to enable the line 98 to be fully received between the plates 36 and 38 within the grooves 56 and 58. After the line 98 has been in position within the grooves 56 and 58 and the plates 36 and 38 have again been returned to a substantially closed position, the clamp screw 82 is swung back to the position thereof illustrated in FIG. 4 and the hand nut 88 may be tightened fully. Then, the user 34, with his weight supported by the straps 16 and 18, may allow his weight to be supported by the line 98 and the lower end of the line 98 extending from the lower ends of the grooves 56 and 58 may be bent back upwardly along the adjacent side of the flange 74 and passed over and through the notch 76 and then again directed downwardly for engagement by the left hand of the user 34. At this point, the user 34 may partially loosen the hand nut 88 and upwardly shift the tail end of the line 90 to loosen the hand nut 88 and upwardly shift the tail end of the line 90 to loosen its engagement in the notch 76. If this is not sufficient to cause the clamp construction 12 to slide down the line 98, the nut 88 is slightly further loosened until downward movement of the clamp construction 12 along the line 98 begins. At this point, the user 34 may retain his right hand in engagement with the nut 88 in order to be ready to tighten the same in the case of any emergency and his left hand may be used to control the descent of the clamp construction 12 along the line 98 by proper upward displacement of the tail end of the line 98 relative to the flange 74.

From FIG. 3 of the drawings, it may be seen that the washer 94 and the adjacent end of the notch 88 project slightly through the relieved or notched areas 70 of the curb 64. In this manner, the adjacent ends of the opposite end portions of the curb 64 embrace not only the washer 94 but also the nut 88 in order to prevent accidental swinging of the clamp screw 82 from its operative position within the slot 68. This, of course, comprises a safety feature.

In order to enable the place 36 to swing toward the phantom line position thereof illustrated in FIG. 4, the marginal portion of the plate 38 is relieved as at 100 to provide the necessary clearance. Further, although the hand nut 38 has been illustrated as constructed of metal and used in conjunction with the anti-friction washer 94, the hand nut 88 could be constructed of a suitable durable plastic, in which case the anti-friction washer 94 would not be required.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rappel clamp comprising:

a first and a second elongated closely opposed juxtaposed plate, said pair of elongated closely opposed juxtaposed plates including opposing and remote sides, said plates defining corresponding first and second longitudinal marginal portions and corresponding first and second transverse end marginal portions;

a substantially full length open ended groove formed in one of the opposing sides of said first longitudinal marginal portions, said groove being partially cylindrical in transverse section;

an outstanding and at least substantially full length rib in the other opposing side of said first longitudinal marginal portions provided with a transversely enlarged outer longitudinal extremity being slidably received and removable from said groove as well as angularly displaceable therein;

full length opposing and registered longitudinal open ended grooves formed in the opposing sides of said plates;

outwardly opening laterally registered slots formed in said second longitudinal marginal portions;

registered transverse outwardly opening slots formed in said second pair of corresponding longitudinal marginal edge portions, a laterally outwardly opening groove formed in said remote side of said first elongated plate, said outwardly opening groove being open at its opposite ends and being generally keyhole-shaped in cross section, said groove outwardly opening into opposite sides of said transverse registered outwardly opening slot at points spaced outward of the inner extremity thereof;

a clamp screw having a first and a second end, one of said ends including means defining a transverse passage therethrough, a pivot pin inserted lengthwise into said laterally outwardly opening groove to a position with said pin spanning said transverse outwardly opening slots, said one end of said screw being loosely received in the laterally outwardly opening slot with said pin rotatbly received through said passage, the other end of said screw having a hand nut threaded thereon, said screw begin disposed with a mid-portion thereof extending through the other outwardly opening slot and said hand nut opposing the other remote side of said plate; and an outstanding flange in one of the remote sides of said plates, said outstanding flange extending longitudinally thereof and is slightly laterally spaced from a position registered with said grooves, the end of said flange facing outwardly of one pair of said transverse end marginal portions having an endwise outwardly opening keyhole-shaped notch formed therein and extending transversely therethrough.

2. The rappel clamp of claim 1 wherein said plates, adjacent one pair of corresponding end marginal portions include registered openings formed therethrough for anchoring a harness relative to said clamp.

3. The rappel clamp of claim 2 wherein said openings are positioned adjacent said first longitudinal marginal portions of said plates.

4. The rappel clamp of claim 1 wherein the opposite ends of said longitudinal grooves are flared.

* * * * *